US007487593B2

(12) United States Patent
Dansreau et al.

(10) Patent No.: US 7,487,593 B2
(45) Date of Patent: Feb. 10, 2009

(54) TRAY FOR A SHAVING IMPLEMENT

(76) Inventors: Paul Dansreau, 14 Basking Rd., Shelton, CT (US) 06484; Donald Roche, 565 Avon Dr., Orange, CT (US) 06477

( * ) Notice: Subject to any disclaimer, the term of this patent is extended or adjusted under 35 U.S.C. 154(b) by 309 days.

(21) Appl. No.: 11/399,027

(22) Filed: Apr. 5, 2006

(65) Prior Publication Data

US 2006/0219583 A1 Oct. 5, 2006

Related U.S. Application Data

(60) Provisional application No. 60/668,760, filed on Apr. 5, 2005.

(51) Int. Cl.
*B26B 21/40* (2006.01)

(52) U.S. Cl. ..... 30/541; 30/34.05; 206/228; 206/351

(58) Field of Classification Search ..... 30/34.05, 30/541; 206/228, 351; D9/749
See application file for complete search history.

(56) References Cited

U.S. PATENT DOCUMENTS

D258,270 S * 2/1981 Gray ..... D9/749
D320,342 S * 10/1991 Gray ..... D9/749
5,240,107 A * 8/1993 Casale ..... 206/354
5,782,346 A * 7/1998 Gray et al. ..... 206/228
D524,169 S * 7/2006 Dansreau et al. ..... D9/749
D546,199 S * 7/2007 Gray et al. ..... D9/749
2005/0172493 A1* 8/2005 Fischer et al. ..... 30/45

FOREIGN PATENT DOCUMENTS

GB 2 398 533 A 5/2004

OTHER PUBLICATIONS

International Search Report dated Jul. 27, 2006.

* cited by examiner

*Primary Examiner*—Hwei-Siu C Payer
(74) *Attorney, Agent, or Firm*—Michaud-Duffy Group LLP

(57) ABSTRACT

According to the present invention, a tray for a shaving implement having a powered device includes a base, at least one engagement structure, and at least one protrusion. The base has a length and a width that are at least approximately as long as a length and a width of the shaving implement, respectively. The base also has a height. The engagement structure (s) are operable to releaseably secure the shaving implement to the tray. The protrusion(s) extend heightwise from the base and are positioned substantially adjacent to a switch on the shaving implement that controls the powered device. The protrusion(s) extend to a height that is at least as high as the switch when the shaving implement is releasably secured in the engagement structure(s) and guard the switch from contact with outside forces that can unintentionally power on the battery-powered device.

6 Claims, 2 Drawing Sheets

TRAY FOR A SHAVING IMPLEMENT

CROSS REFERENCE TO RELATED APPLICATIONS

This application is entitled to the benefit of and incorporates by reference the disclosure of U.S. Patent Application 60/668,760 filed on Apr. 5, 2005, entitled "Tray for a Shaving Implement."

BACKGROUND OF THE INVENTION

1. Field of the Invention

The present invention relates generally to a tray for shaving implements, and, more particularly, to a tray for a shaving implement having a powered device therein.

2. Description of the Prior Art

Modern shaving implements can include a plurality of blades disposed within a razor cartridge. The razor cartridge is, in turn, mounted on a handle during use. Some safety razors have a disposable razor cartridge that is removably mounted on a reusable handle while others have a handle and a razor cartridge that are manufactured as a single, disposable unit.

Certain powered devices, such as a motorized eccentric weight that spins, inside the handle. The powered devices typically either enhance the ability of the shaving implement to provide a close, smooth, and comfortable shave, or enable to the razor to perform functions wholly separate from shaving (e.g., radio). In most cases, the powered device requires the use of a replaceable, or rechargeable, battery, and a switch. The switch typically can be toggled between on and off, or, where the powered device may have various settings, between any one of the positions that corresponds to different settings.

Batteries have a limited lifespan. Therefore, it is advantageous that the replaceable (or rechargeable) battery's stored energy be used as efficiently as possible in order to prevent the user from having to replace, or recharge, the battery more frequently than expected. Unfortunately, in many instances, the powered device is accidentally switched on when the user is not benefiting from the function of the powered device.

It is, therefore, an object of the present invention to overcome the known shortcomings of the prior art.

SUMMARY OF THE DISCLOSURE

According to one aspect of the present invention, a tray for a shaving implement having a powered device includes a base, at least one engagement structure, and at least one protrusion. The base has a length and a width that are at least approximately as long as a length and a width of the shaving implement, respectively. The base also has a height. The engagement structure(s) are operable to releaseably secure the shaving implement to the tray. The protrusion(s) extend heightwise from the base and are positioned substantially adjacent to a switch on the shaving implement that controls the powered device. The protrusion(s) extend to a height that is at least as high as the switch when the shaving implement is releasably secured in the engagement structure(s).

According to another aspect of the present invention, the at least one protrusion is operable to inhibit activating the switch controlling the powered device of the shaving implement when the shaving implement is releasably secured in the at least one engagement structure.

According to another aspect of the present invention, the tray has at least two protrusions and at least one protrusion is located on one side of the shaving implement, and at least one other protrusion is located on a second side of the shaving implement.

One advantage of the present invention is that the protrusion(s) will prevent the powered device of the shaving implement from being activated; accordingly, the power of the battery will be less likely to be wasted through unintended operation of the powered device when the shaving implement is not in use.

Another advantage of the present invention is that the protrusion(s) will prevent the powered device of the shaving implement from being activated during the initial shipment of the product from the factory to the store. Therefore, the powered device will be less likely to be activated inside sales packaging during the initial shipment of the shaving implement, and the user will not receive a brand new product that includes a drained battery.

These and other advantages of the present invention will be apparent to one skilled in the art in light of the Figures, Detailed Description, and Claims.

DETAILED DESCRIPTION

Figure 1:
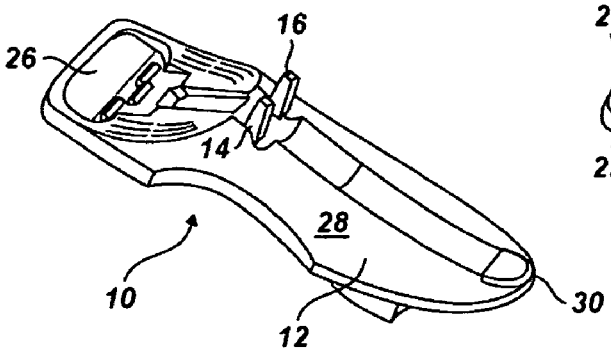
FIG. 1 is a perspective view of one embodiment of the present invention.
Figure 1A:
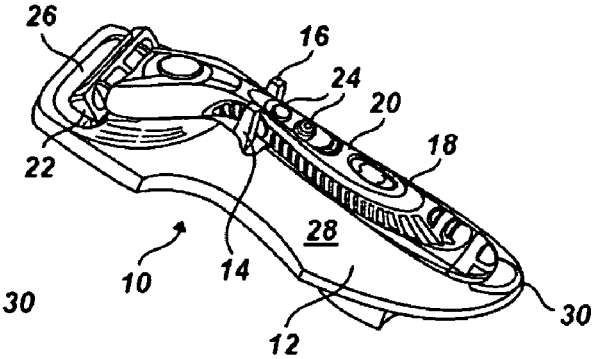
FIG. 1A is a perspective view of the tray of FIG. 1 with a shaving implement secured thereon.

Referring to FIGS. 1 and 1A, the tray of the present invention is generally identified by the numeral 10. The tray includes a base 12, at least one engagement structure 14, and at least one protrusion 16. The engagement structure 14 is operable to releaseably secure a shaving implement 18 to the tray 10.

Figure 2:
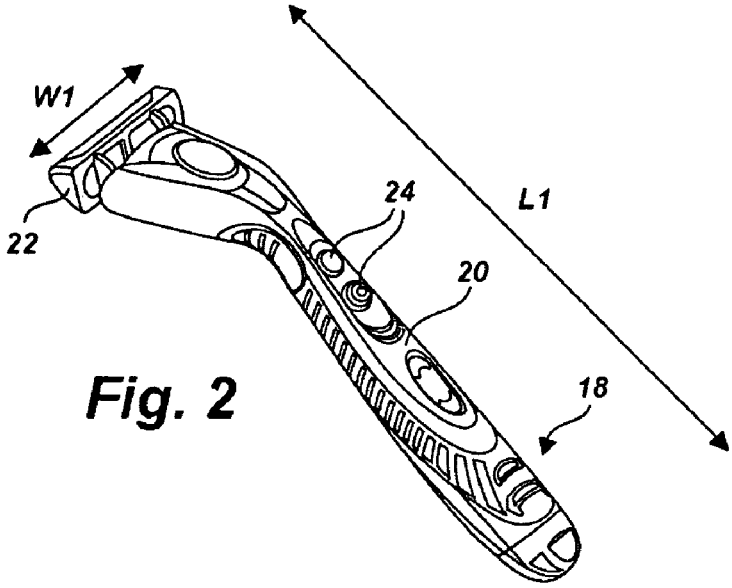
FIG. 2 is a perspective view of a shaving implement having a battery-powered device therein.
Figure 5:
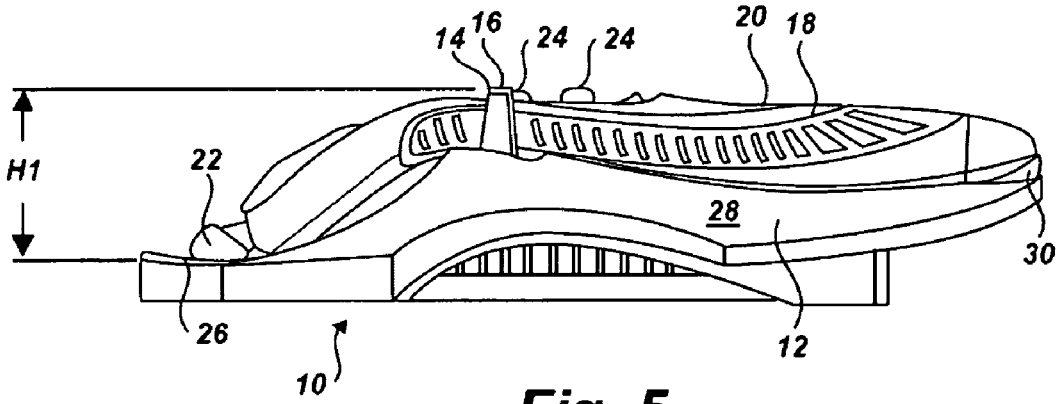
FIG. 5 is a side view of the tray shown in FIG. 4 with a shaving implement secured thereon.

One example of a shaving implement 18 having a battery-powered device therein (hidden) is shown in FIG. 2. The shaving implement 18, also often referred to as a wet shave razor, includes a handle 20 and a cartridge 22. The shaving implement 18 defines a length ("L1"), width ("W1") and height ("H1", see FIG. 5), and includes a switch 24 for operating the battery-powered devices. The switch 24 may be a push button-type where successive depressions turn the battery-powered device on or off. Alternatively, the switch 24 may be a toggle-type where the battery-powered device is activated when the switch is in one position, and turns the battery-powered device off in a second position. Although the toggle-type switch is shown in FIG. 2, numerous other types of switches are also well-known in the art, and will not be discussed in greater detail herein other than to say that the present invention is not limited to use with a shaving implement having any particular type of switch. The switch 24 can be located anywhere on the handle; however, it is often preferable that the switch 24 is located on the handle such that a user that is otherwise unfamiliar with the shaving implement 18 can immediately locate the switch 24 when the shaving implement 18 is secured on the tray (for example, see FIG.

1A). Accordingly, the switch 24 is often exposed, and susceptible to contact with outside forces.

Figure 3:
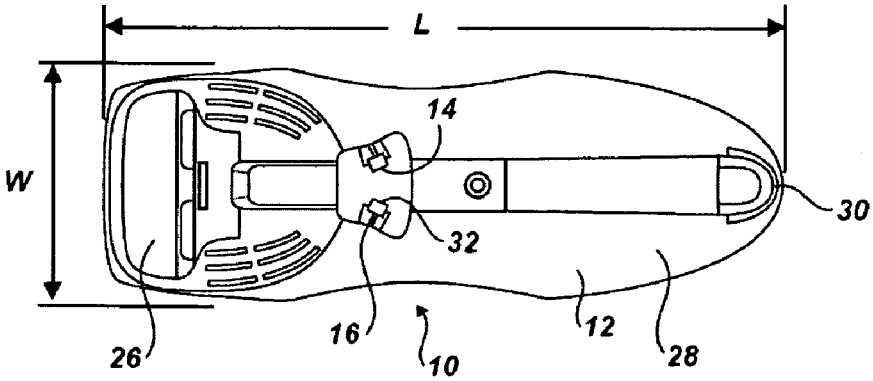
FIG. 3 is a top view of the tray shown in FIG. 1.
Figure 4:
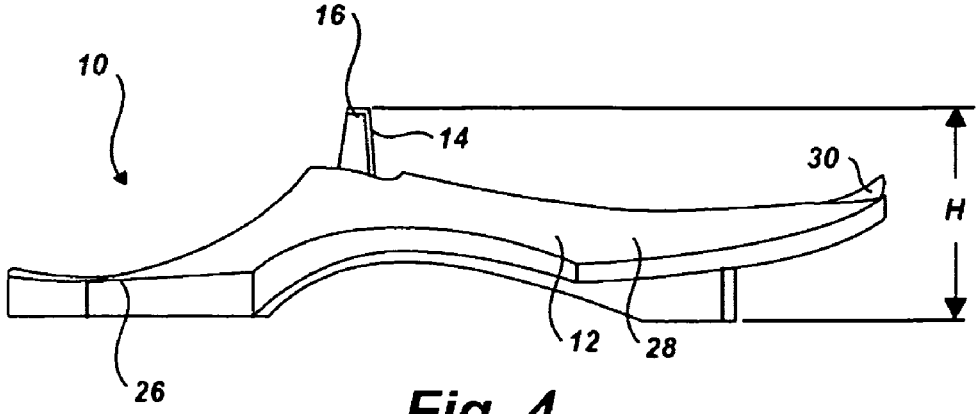
FIG. 4 is a side view of the tray shown in FIG. 1.

The base 12 of the tray 10, as shown in FIGS. 3-4, has a length ("L"), width ("W") and height ("H"). In some embodiments, the tray 10 may be generally rectangular. Additionally or alternatively, the tray 10 may have a contoured shape. Typically, the tray 10 will also include a front portion 26 that is shaped and sized to complement the razor cartridge 22 of the shaving implement 18, such that the tray 10 effectively protects the one or more razor blades when the shaving implement 18 is mounted thereon. The tray 10 also typically includes a rear portion 28 that underlies the handle 20 of the shaving implement 18 when it is secured on the tray 10. It is preferable that the length ("L") of the tray 10 exceeds the length ("L1") of the shaving implement 18 such that the tray 10 underlies the entire shaving implement 18 when it is secured on the tray 10. However, the present invention should not be considered to be so limited. For example, in some embodiments, and although not shown, the handle 20 of the shaving implement 18 may extend past an end 30 of the tray 10 when secured thereon without departing from the scope of the present invention.

Referring now to FIGS. 4-7, the tray 10 includes an engagement structure 14 that is operable to selectively receive the shaving implement 18 and secure the shaving implement 18 to the tray 10. The engagement structure 14 as shown in, for example, FIG. 4 can include two (2) projections 32. Each projection 32 extends upwards from the base 12 on opposing sides of the razor handle 20. When the shaving implement 18 is placed on the tray 10, it is captured between the projections 32 and the base 12 and secured thereon. However, the present invention should not be considered to be limited to the above example. Numerous types of engagement structures 14 are known to those of skill in the an. For example, in some instances, the shaving implement 18 may include one or more apertures (not shown) that are complimentary to engagement structure(s) 14 on the base 12. In these embodiments, the shaving implement 18 is placed on the tray 10 such that the engagement structure(s) 14 enter the aperture(s), and secure the shaving implement 18 to the tray 10. In addition, in some instances, the tray 10 may include several engagement structures 14 that extend from the base 12 at various locations along the length ("L1") of the shaving implement 18, and that are operable to secure the shaving implement 18 to the base 10.

Figure 6:
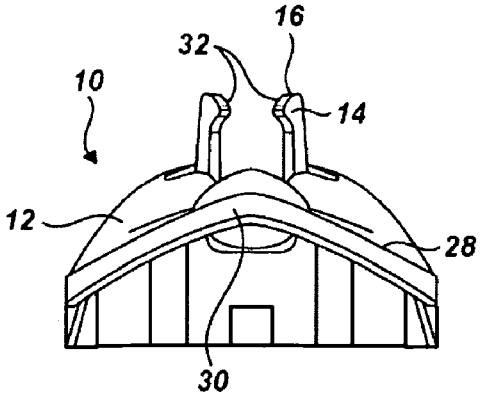
FIG. 6 is a rear view of the tray shown in FIG. 1.
Figure 7:
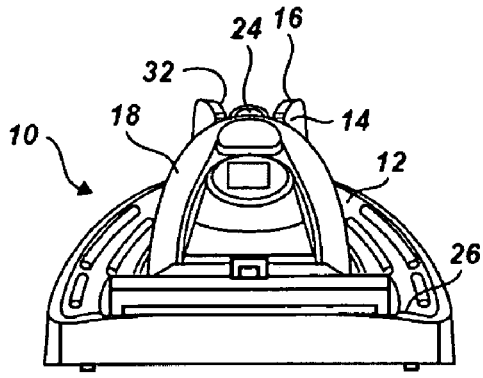
FIG. 7 is a front view of the tray shown in FIG. 1 with a shaving implement secured thereon.

Referring to FIGS. 3-7, the tray 10 further includes at least one protrusion 16 that is operable to protect the switch 24 on the shaving implement 18 from being unintentionally struck by outside forces. The protrusions 16 can have any suitable cross-sectional shape (see e.g., FIG. 3), are typically located within a close proximity to the switch 24 that operates the battery-powered device (see FIGS. 5 and 7), and extend upwards from the base 12 to a height that is at least as high as the height of the switch 24 (see FIGS. 5 and 7). Therefore, the location, shape and height of the protrusion(s) 16 will vary depending on the location of the actual switch 24 the protrusion(s) 16 guards. In some embodiments, such as is shown in FIGS. 6 and 7, the base 12 may include a plurality of protrusions 16 that guard the switch 24 on the shaving implement 18 from being unintentionally struck by outside forces that may approach the switch at various angles. For example, as shown in FIG. 3, the base 12 may include protrusions 16 that are located on either side of the switch 24.

In some instances, such as the one shown in FIGS. 6 and 7, the protrusion(s) 16 may be integrally formed with one or more of the engagement structure(s) 14. For example, as shown in FIG. 7, the protrusions 16 extend upwards from engagement structures 14.

In operation, the user selectively places the shaving implement 18 on the tray 10 when the shaving implement 18 is not in use such that the engagement structures 14 on the base 12 receive the shaving implement 18 and secure it to the tray 10. While the shaving implement 18 is secured to the tray 10, the one or more protrusions 16 guard the switch 24 from outside forces accidentally contacting the switch 24 and unintentionally powering on the battery-operated device when the benefits of the battery-operated device are not being realized by the user. In effect, the protrusion(s) 16 prevent the battery from undesirably being drained of power when not in use. In other words, protection means for guarding the switch 24 controlling the powered device of the shaving implement 14 from contact with outside forces when the shaving implement 14 is releasably secured in the at least one engagement structure (14) is shown and described.

Modification and variations may be made to the disclosed embodiments without departing from the subject and spirit of the invention as defined by the following claims.

What is claimed is:

1. A tray in combination with a shaving implement having a powered device, wherein the combination comprising:

a base having a length and a width, the length and the width of the base being at least approximately as long and wide as a length and a width of the shaving implement, respectively, the base also having a height;

an engagement structure attached to the base that is operable to releaseably secure the shaving implement in place;

the shaving implement being releasably secured to the engagement structure, the shaving implement having a handle that includes a first end where a razor cartridge is attached, a second end at an opposite end of the handle away from the razor cartridge, and a bend that is located between the first and second ends, the shaving implement further having a bottom side that, when releasably attached to the base, is adjacent the base, and a top side that generally faces away from the base when the shaving implement is releasably attached to the base;

a switch that controls the powered device being located on the top side of the handle of the shaving implement between the bend and the second end; and at least two protrusions extending heightwise from the base, the at least two protrusions being positioned such that at least a portion of the switch controlling the powered device is located directly between the at least two protrusions;

wherein at least one of the protrusions extends at least as high as the switch when the shaving implement is releasably secured in the engagement structure and wherein the at least one protrusion is integrally formed with the engagement structure.

2. The combination of claim 1, wherein the at least one protrusion is operable to inhibit accidental activation of the powered device of the shaving implement when the shaving implement is releasably secured in the engagement structure.

3. The combination of claim 1, wherein the protrusion is located on either side of the shaving implement when the shaving implement is releasably secured in the engagement structure.

4. A tray in combination with a shaving implement having a powered device, wherein the combination comprising:

a base having a length and a width, the length and the width of the base being at least approximately as long as a length and a width of the shaving implement, respectively;

at least one engagement structure, the engagement structure being operable to releaseably secure the shaving implement in place;

the shaving implement being releasably secured to the engagement structure, the shaving implement having a handle that includes a first end where a razor cartridge is attached, a second end at an opposite end of the handle away from the razor cartridge, and a bend that is located between the first and second ends, the shaving implement further having a bottom side that, when releasably attached to the base, is adjacent the base, and a top side that generally faces away from the base when the shaving implement is releasably attached to the base;

a switch that controls the powered device being located on the top side of the handle of the shaving implement between the bend and the second end; and a means for guarding the switch controlling the powered device of the shaving implement from contact with outside forces when the shaving implement is releasably secured in the at least one engagement structure;

wherein the means for guarding the switch is integrally formed with the engagement structure.

5. A tray in combination with a shaving implement having a powered device, wherein the combination comprising:

a base;

at least one engagement structure attached to the base, the engagement structure being operable to releasably secure the shaving implement in place;

the shaving implement being releasably secured to the engagement structure, the shaving implement having a handle that includes a first end where a razor cartridge is attached, a second end at an opposite end of the handle away from the razor cartridge, and a bend that is located between the first and second ends, the shaving implement further having a bottom side that, when releasably attached to the base, is adjacent the base, and a top side that generally faces away from the base when the shaving implement is releasably attached to the base;

a switch that controls the powered device being located on the top side of the handle of the shaving implement between the bend and the second end; and protection means for guarding the switch controlling the powered device of the shaving implement from contact with outside forces when the shaving implement is releasably secured in the at least one engagement structure;

wherein the protection means is integrally formed with the engagement structure.

6. The combination of claim 5, wherein the base has a length and a width, the length and the width of the base being at least approximately as long as a length and a width of the shaving implement, respectively.

* * * * *